US008238806B2

(12) United States Patent
Yano

(10) Patent No.: US 8,238,806 B2
(45) Date of Patent: Aug. 7, 2012

(54) IMAGE FORMING APPARATUS AND IMAGE FORMING METHOD

(75) Inventor: Fuminori Yano, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 168 days.

(21) Appl. No.: 12/892,329

(22) Filed: Sep. 28, 2010

(65) Prior Publication Data

US 2011/0123236 A1 May 26, 2011

(30) Foreign Application Priority Data

Nov. 20, 2009 (JP) ..... 2009-264607

(51) Int. Cl.
*G03G 15/01* (2006.01)
*G03G 15/00* (2006.01)

(52) U.S. Cl. ..... 399/304; 399/397

(58) Field of Classification Search ..... 399/304, 399/305, 297, 397, 400
See application file for complete search history.

(56) References Cited

U.S. PATENT DOCUMENTS 4,403,847 A * 9/1983 Chrestensen ..... 399/305
4,875,069 A * 10/1989 Takada et al. ..... 399/304
5,006,900 A * 4/1991 Baughman et al. ..... 399/305
5,223,903 A * 6/1993 Russel et al. ..... 399/400
6,163,676 A 12/2000 Levanon et al.
6,957,035 B1 * 10/2005 Giannetti et al. ..... 399/397
2009/0190981 A1 7/2009 Tanaka

FOREIGN PATENT DOCUMENTS

JP 2000-508280 T 7/2000
JP 2009-205131 A 9/2009
WO WO-97/09262 A1 3/1997

* cited by examiner

*Primary Examiner* — Susan Lee
(74) *Attorney, Agent, or Firm* — Global IP Counselors, LLP

(57) ABSTRACT

An image forming apparatus is provided which includes: an image carrier that carries an image; a transfer roller that includes a gripping member, and transfers the image to the transfer medium; a suction guide portion that includes a suction unit, and suctions and guides the transfer medium transferred the image, vertically upward with a plane transferred the image of the transfer medium being directed vertically downward; and a transfer medium transporting section that includes a suction member and transports the transfer medium while suctioning the transfer medium by the suction member, the transfer medium transporting section being configured such that a position of starting to suction the transfer medium is arranged at a position having a predetermined relationship with respect to a position of releasing the transfer medium from the gripping member and a position at which the image carrier is separated from the transfer medium.

7 Claims, 10 Drawing Sheets

IMAGE FORMING APPARATUS AND IMAGE FORMING METHOD

BACKGROUND

1. Technical Field

The present invention relates to an image forming apparatus and an image forming method in which transfer is performed in a state of gripping a transfer medium.

2. Related Art

In the past, among image forming apparatuses, there has been proposed an image forming apparatus in which a transfer roller having a transfer medium gripping member that grips an edge portion of a transfer medium is used (see, for example, JP-T-2000-508280). In the image forming apparatus disclosed in JP-T-2000-508280, by the rotation of the transfer roller, the transfer medium passes through a transfer nip in a state where the apical portion of the transfer medium is gripped by the transfer medium gripping member, and an image on an image carrier is transferred to the transfer medium. After the apical portion of the transfer medium passes through the transfer nip, the gripping of the transfer medium is released and thus the transfer medium is released. According to this image forming apparatus, the transfer medium is reliably detached from the image carrier after the transfer by gripping the apical portion of the transfer medium by the transfer medium gripping member.

On the other hand, there is proposed an image forming apparatus in which, by the rotation of the transfer roller, the transfer medium passes through the transfer nip and the image of the image carrier is transferred to the transfer medium, and when the apical portion of the transfer medium passes through the transfer nip the transfer medium is detached from the image carrier by an airflow generating device, and then the transfer medium is moved from a downward position to an obliquely upward position in a state where the transfer image plane thereof is directed downward, and is transported to a fixing section side by a transfer medium transporting belt of a transfer medium transporting section (see, for example, JP-A-2009-205131).

Incidentally, it is considered that a technique for gripping the apical portion of the transfer medium disclosed in JP-T-2000-508280 is applied to the image forming apparatus disclosed in JP-A-2009-205131, in order to improve detachability of the transfer medium from the image carrier after the transfer. In this case, since the gripping of the apical portion of the transfer medium is released just before the transfer medium transporting section, a nip termination position of the transfer nip in a transfer medium moving direction, a transfer medium releasing position, and a transfer medium transporting section starting point position of the transfer medium transporting belt with which the leading end of the transfer medium initially comes into contact are disposed in an approximately virtual triangle. Therefore, the transfer medium passing through the transfer nip is moved on the moving pathway substantially along two sides of the approximately virtual triangle, that is, the side between the nip termination position of the transfer nip and the transfer medium releasing position and the side between the transfer medium releasing position and the transfer medium transporting section starting point position of the transfer medium transporting belt, by the rotation of the transfer roller and the image carrier.

However, when the leading end of the transfer medium reaches the transfer medium transporting section starting point position of the transfer medium transporting belt, the transfer medium is bent downward due to its own weight using the transfer medium transporting section starting point position and the nip termination position of the transfer nip as a supporting point, and is moved substantially along another side of the approximately virtual triangle between the transfer medium transporting section starting point position and the nip termination position. For this reason, the length of the moving pathway of the transfer medium is reduced, and thus the transfer medium is loosened and further bent downward. Then, the transfer image plane of the transfer medium passing through the transfer nip contacts the image carrier again, or contacts the members of the image forming apparatus arranged under the moving pathway of the transfer medium. As a result, the transferred image becomes disordered. In addition, the transfer position of the transfer medium varies subtly with the looseness of the transfer medium, and image deviation is generated by the variation of the width of the transfer nip. As seen from the above, just simply applying the technique for gripping the transfer medium disclosed in JP-T-2000-508280 to the image forming apparatus disclosed in JP-A-2009-205131 makes it difficult to obtain a good image.

SUMMARY

An advantage of some aspects of the invention is that it provides an image forming apparatus and an image forming method capable of obtaining a good image, even when the transfer nip, the transfer medium releasing position, and the transfer medium transporting section starting point position are disposed in an approximately virtual triangle in performing the transfer in a state of gripping the transfer medium.

According to the aspects of the invention, in an image forming apparatus and an image forming method of the invention, a transfer medium is gripped by a gripping member, and an image of an image carrier is transferred to the transfer medium by a transfer nip. Next, after the transfer the transfer medium to which the image is transferred is detached from the image carrier at a position where it is separated from the image carrier, and the gripping of the transfer medium by the gripping member is released at a transfer medium releasing position and thus the transfer medium is released. Next, through airflow suction of a suction unit in a suction guide portion, the transfer medium is guided and moved in a transfer medium moving direction from a vertically downward position to an obliquely upward position toward a transfer medium transporting section while the rear surface side thereof (side reverse to a transfer image plane) is suctioned. After that, the transfer medium reaches a position at which the transfer medium transporting section starts to suction the transfer medium. In that case, a position at which the image carrier and the transfer medium are separated from each other, a position at which the gripping member releases the transfer medium, and a position at which the transfer medium transporting section starts to suction the transfer medium are disposed in a virtual triangle when viewed from a direction perpendicular, or substantially perpendicular, to the transfer medium moving direction. Therefore, the transfer medium is moved substantially along the moving pathway of two sides formed by one side of the virtual triangle that links the position at which the image carrier and the transfer medium are separated from each other and the position at which the gripping member releases the transfer medium, and one side of the virtual triangle that links the position at which the gripping member releases the transfer medium and the position at which the transfer medium transporting section starts to suction the transfer medium. When the distance that links the position at which the image carrier and the transfer medium are separated from each other and the position at which the transfer medium transporting section starts to suction the transfer medium is set to L, the distance that links the position at which the image carrier and the transfer medium are separated from each other and the position at which the gripping member releases the transfer medium is set to L1, and the distance that links the position at which the gripping member releases the transfer medium and the position at which the transfer medium transporting section starts to suction the transfer medium is set to L2, L has a relationship of L<L1+L2 with respect to L1 and L2. Therefore, when the transfer medium reaches the position at which the transfer medium transporting section starts to suction the transfer medium, the transfer medium is bent downward due to its own weight using the transfer nip termination position and the transfer medium transporting section starting point position as a supporting point, and is moved on the moving pathway substantially along another side of the approximately virtual triangle between the position at which the transfer medium is separated from the image carrier and the position at which the transfer medium transporting section starts to suction the transfer medium. For this reason, the length of the moving pathway of the transfer medium is reduced from L1+L2 to L. Consequently, the transfer medium can be located at the suction guide portion side rather than at another side of the approximately virtual triangle by controlling the flow rate (suction rate) of the airflow of the suction unit in the suction guide portion by the control section. Thereby, it is possible to reduce a change in the length of the moving pathway of the transfer medium, and to suppress the looseness of the transfer medium caused by this change in the length of the moving pathway of the transfer medium. Therefore, it is possible to prevent the transfer image plane of the transfer medium passing through the transfer nip from contacting the members of the image forming apparatus, such as the image carrier, which are arranged vertically under the moving pathway of the transfer medium between the position at which the image carrier and the transfer medium are separated from each other and the position at which the transfer medium transporting section starts to suction the transfer medium. As a result, it is possible to prevent the disordering of the transferred image. In addition, since the looseness of the transfer medium is reduced, it is possible to reduce a change in the width of the transfer nip caused by a tiny change in the transfer position of the transfer medium, and to suppress the generation of image deviation. In this way, even when the position at which the image carrier and the transfer medium are separated from each other, the transfer medium releasing position, and the position at which the transfer medium transporting section starts to suction the transfer medium are disposed in an approximately virtual triangle in performing the transfer in a state of gripping the transfer medium, it is possible to realize the image forming apparatus and the image forming method capable of obtaining a good image.

In particular, when the thickness of the transfer medium input to a transfer medium information input section is a first thickness, the control section sets the flow rate of the airflow generated by an airflow generating unit, which is the suction unit of the suction guide portion, to a first flow rate, and when the thickness of the transfer medium input to the transfer medium information input section is a second thickness larger than the first thickness, the control section sets the flow rate of the airflow generated by the airflow generating unit to a second flow rate larger than the first flow rate. That is, the control section selectively controls the suction power of the suction unit of the suction guide portion with any of the first suction power by the first flow rate or the second suction power by the second flow rate larger than the first suction power on the basis of information on the thickness of the transfer medium. Thereby, it is possible to more reliably prevent the transfer image plane of the transfer medium passing through the transfer nip from contacting the members of the image forming apparatus arranged under the moving pathway of the transfer medium mentioned above in response to the thickness of the transfer medium.

In addition, the control section controls the suction power of the suction unit of the suction guide portion on the basis of the transport position of the transfer medium detected by a transport position detecting unit. Thereby, it is possible to efficiently control the suction power of the suction unit, and to more reliably perform the suction guide of the transfer medium by the suction guide portion.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, the modes for carrying out the invention will be described with reference to the drawings.

Figure 1:
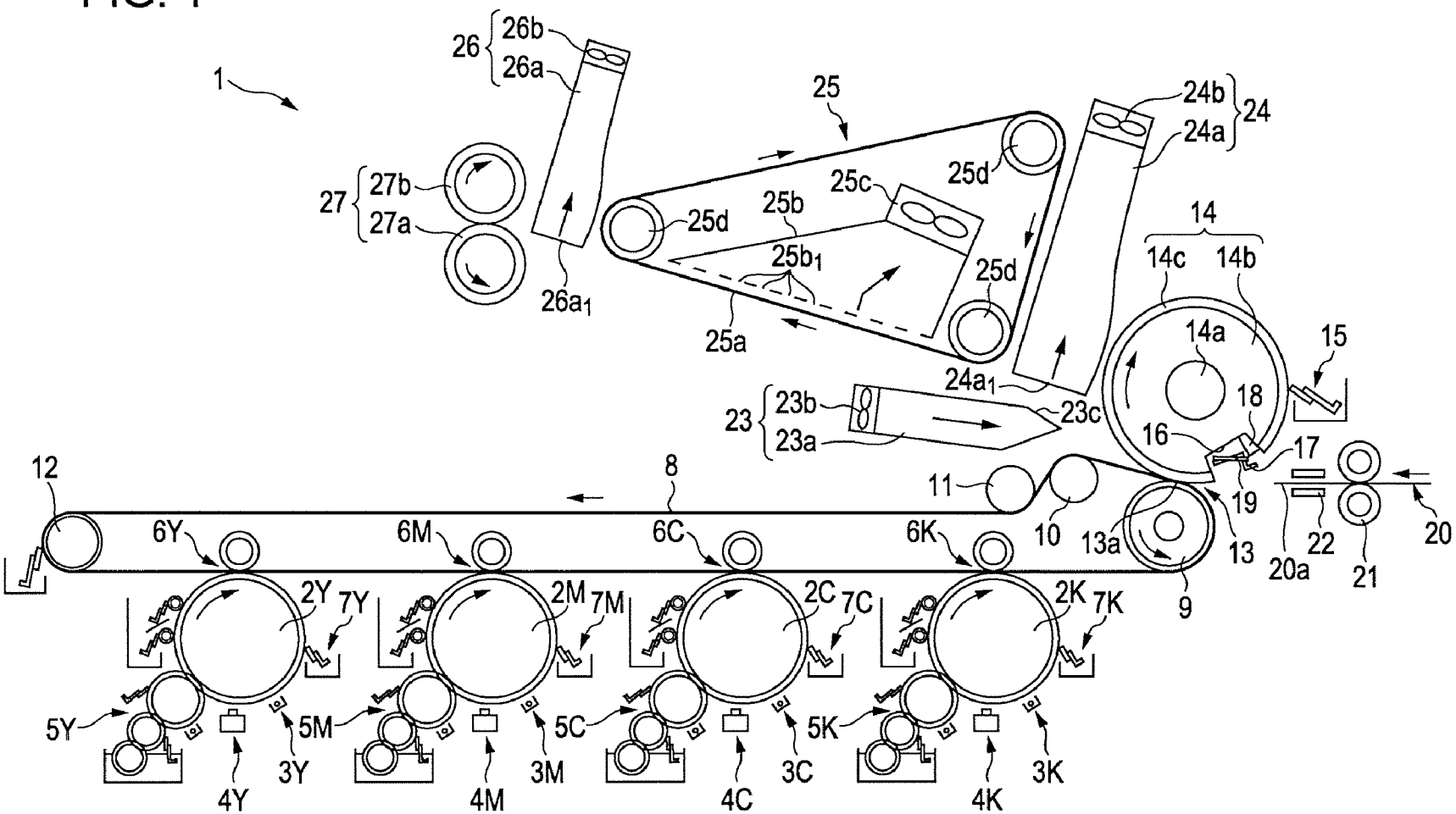
FIG. 1 is a diagram schematically and partially illustrating a portion of an example of an embodiment of an image forming apparatus according to the invention.

FIG. 1 is a diagram schematically and partially illustrating a portion of an example of an embodiment of an image forming apparatus according to the invention.

An image forming apparatus 1 of this example performs the image formation using liquid developer including toner and carrier liquid. As shown in FIG. 1, the image forming apparatus 1 includes photoreceptors 2Y, 2M, 2C, and 2K which are image carriers of yellow (Y), magenta (M), cyan (C) and black (K) disposed in tandem horizontally or substantially horizontally. Here, in each of the photoreceptors 2Y, 2M, 2C, and 2K, 2Y denotes a yellow photoreceptor, 2M denotes a magenta photoreceptor, 2C denotes a cyan photoreceptor, and 2K denotes a black photoreceptor. In addition, similarly to the other members, the members of each color are denoted by assigning each color of Y, M, C, and K, respectively, to the signs of the members.

In addition, charging sections 3Y, 3M, 3C, and 3K are respectively arranged on the periphery of each of the photoreceptors 2Y, 2M, 2C, and 2K. Further, exposure sections 4Y, 4M, 4C, and 4K, developing sections 5Y, 5M, 5C, and 5K, primary transfer sections 6Y, 6M, 6C, and 6K, and photoreceptor cleaning sections 7Y, 7M, 7C, and 7K are arranged in this order from each of the charging sections 3Y, 3M, 3C, and 3K toward the rotational direction of each of the photoreceptors 2Y, 2M, 2C, and 2K, respectively. In the meantime, each of the photoreceptors 2Y, 2M, 2C, and 2K is neutralized by a neutralization section, not shown, after the primary transfer. An image forming unit of the image forming apparatus 1 of this example is constituted by each of the photoreceptors 2Y, 2M, 2C, and 2K, each of the charging sections 3Y, 3M, 3C, and 3K, each of the exposure sections 4Y, 4M, 4C, and 4K, each of the developing sections 5Y, 5M, 5C, and 5K, each of the primary transfer sections 6Y, 6M, 6C, and 6K, each of the photoreceptor cleaning sections 7Y, 7M, 7C, and 7K, and each of the neutralization sections.

In addition, the image forming apparatus 1 includes an endless intermediate transfer belt 8 which is the image carrier of the invention. This intermediate transfer belt 8 is disposed above each of the photoreceptors 2Y, 2M, 2C, and 2K. The intermediate transfer belt 8 comes into press-contact with each of the photoreceptors 2Y, 2M, 2C, and 2K in each of the primary transfer sections 6Y, 6M, 6C, and 6K.

Although not shown, the intermediate transfer belt 8 is formed of, for example, a relatively flexible elastic belt having a three-layer structure with a flexible base such as resin, an elastic layer such as rubber formed on the surface of this base, and the outer layer formed on the surface of this elastic layer. Of course, it is not limited thereto. The intermediate transfer belt 8 is wound around an intermediate transfer belt driving roller 9 to which the driving force of a motor, not shown, is transmitted, a first winding roller 10, a second winding roller 11, and an intermediate transfer belt tension roller 12. The intermediate transfer belt 8 is configured to be rotated in an arrow direction in a state where tension is applied thereto. Meanwhile, the disposition order of the members such as the photoreceptors corresponding to each of the colors Y, M, C, and K can be arbitrarily set without being limited to the example shown in FIG. 1.

Figure 2:
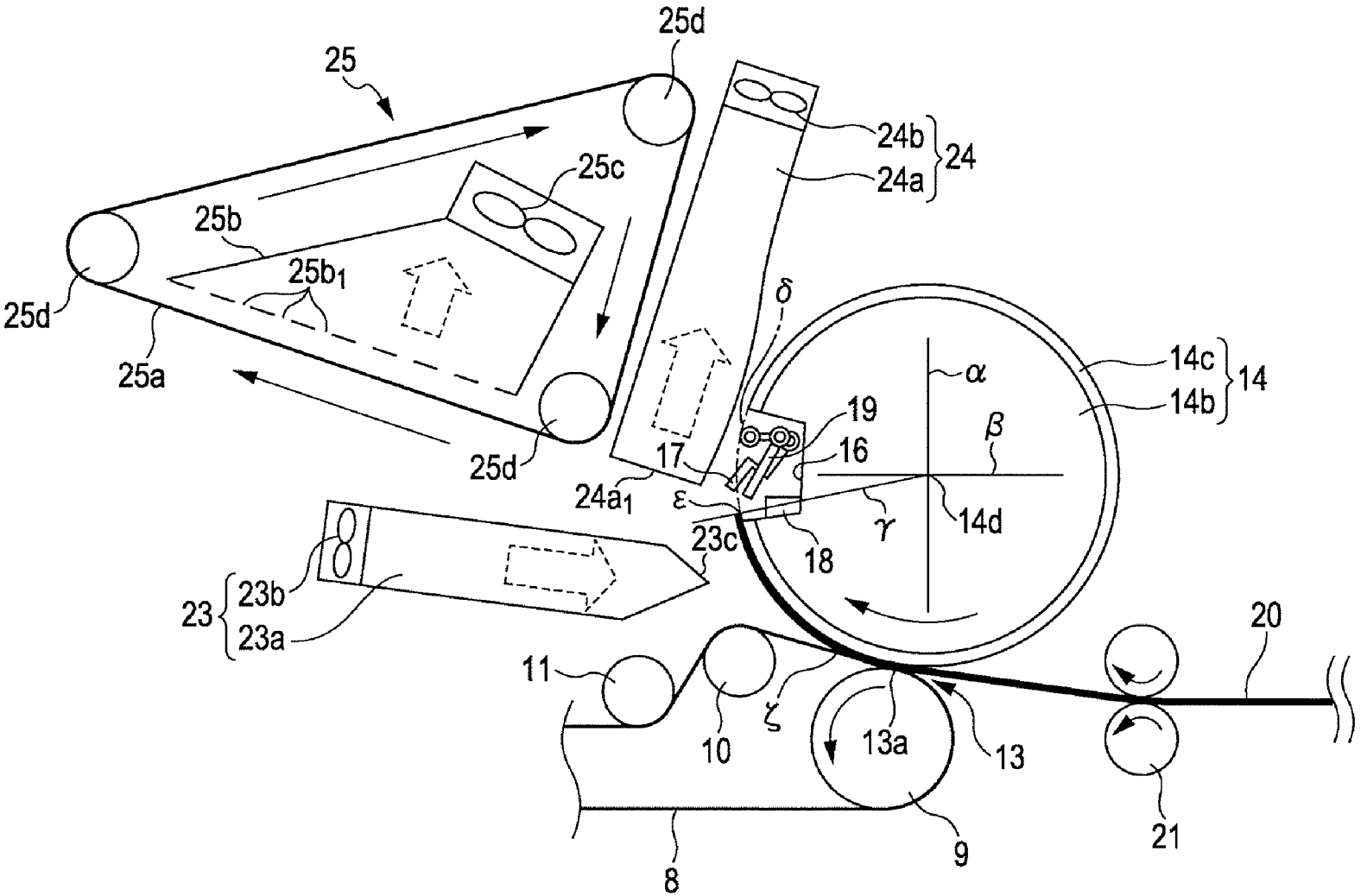
FIG. 2 is a partially enlarged view of the image forming apparatus in FIG. 1.

A secondary transfer section 13 is provided on the intermediate transfer belt driving roller 9 side of the intermediate transfer belt 8. The secondary transfer section 13 includes a secondary transfer roller 14 and a secondary transfer roller cleaning section 15. The secondary transfer roller 14 is rotated in a direction shown in an arrow centered on a rotary shaft 14*a*. This secondary transfer roller 14 comes into press-contact with the intermediate transfer belt 8 wound around the intermediate transfer belt driving roller 9. At this time, as shown in FIG. 2, the secondary transfer roller 14 comes into press-contact with the intermediate transfer belt 8 at the left side in FIG. 2 from the virtual vertical line a passing through the rotational center 14*d* of the secondary transfer roller 14, and at the lower side of the vertical direction in FIG. 2 from the virtual horizontal line β passing through the rotational center 14*d* thereof. In addition, the intermediate transfer belt driving roller 9 functions as a backup roller with respect to the pressing force of the secondary transfer roller 14. Further, the secondary transfer roller 14 comes into press-contact with the intermediate transfer belt 8, so that it is rotated together with the intermediate transfer belt 8 (in other words, the intermediate transfer belt driving roller 9).

Further, the secondary transfer roller 14 has a sheet-like elastic member 14*c* wound around the outer circumference plane of the arc portion of a base 14*b*. A resistive layer is formed on the outer circumference plane of the arc portion of the secondary transfer roller 14 by this elastic member 14*c*. As shown in FIG. 1, a secondary transfer nip 13*a* is formed between the intermediate transfer belt 8 and the elastic member 14*c* of the secondary transfer roller 14. As shown in FIG. 2, this secondary transfer nip 13*a* is disposed at the above-mentioned image forming unit side (the left side in FIG. 2) from the virtual vertical line α, and is disposed at the image forming unit side (the lower side of the vertical direction in FIG. 2) from the virtual horizontal line β.

As shown in FIG. 1, FIG. 2, FIG. 3A to 3C, the secondary transfer roller 14 has a concave portion 16. A gripper 17 used as a transfer medium gripping member, a gripper supporting portion 18 which is a member receiving the transfer medium gripping member on which the gripper 17 is seated, and a protruding claw 19 used as a transfer medium detaching member are arranged within this concave portion 16.

Figure 3A:
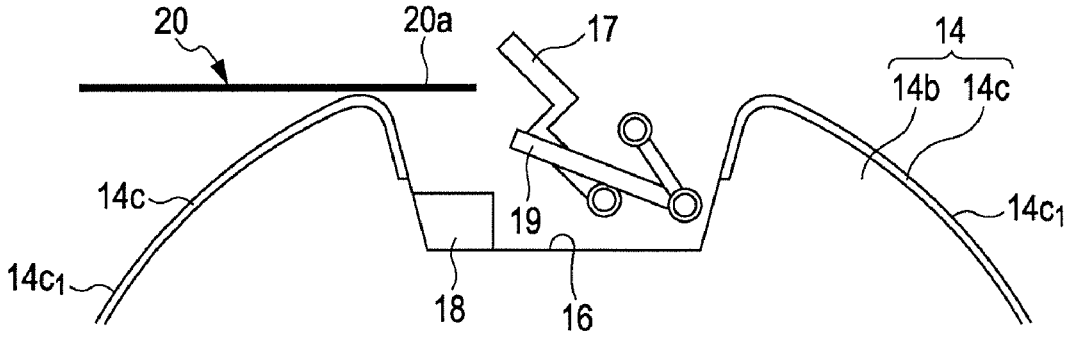
FIG. 3A is a diagram illustrating a state just before the apical portion of a transfer medium is gripped.
Figure 3B:
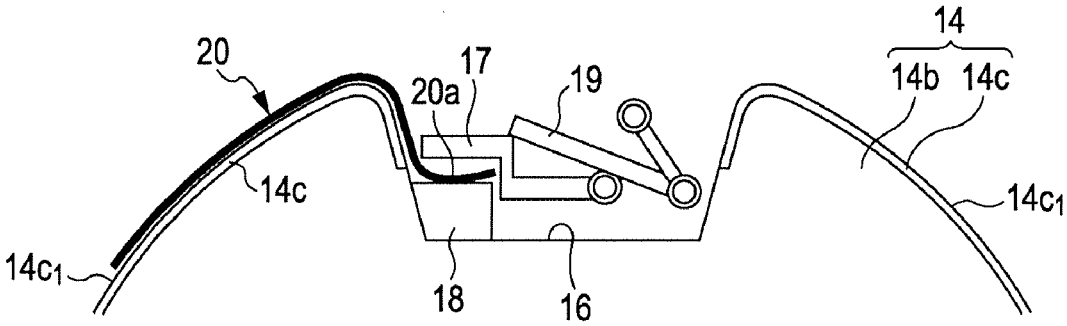
FIG. 3B is a diagram illustrating a state where the apical portion of the transfer medium is gripped.

The gripper 17 is provided so as to swing between a transfer medium gripping releasing position shown in FIG. 3A and a transfer medium gripping position shown in FIG. 3B. In this case, the gripper 17 is configured such that in the transfer medium gripping releasing position, a portion thereof is protruded to the outside from the circumference of the virtual circle δ having the same diameter as the outer circumference plane $14c_1$ of the elastic member 14*c* of the secondary transfer roller 14, in other words, to the outside of the concave portion 16, and that in the transfer medium gripping position, the entirety thereof is received within the inside from the circumference of the virtual circle δ, in other words, within the concave portion 16. In addition, the protruding claw 19 is provided so as to move approximately linearly between a retreat position shown in FIG. 3A and a protruding position shown in FIG. 3C. In this case, the protruding claw 19 is configured such that in the retreat position, the entirety thereof is received within the concave portion 16, and in the protruding position, a portion thereof is protruded from the concave portion 16. Although not shown, each of the operations of the gripper 17 and protruding claw 19 is respectively controlled by each of the cams fixed to the main body of the image forming apparatus 1 and the like.

In that case, a transfer medium gripping starting position at which the gripper 17 starts to gripping the apical portion 20*a* of the transfer medium 20 is provided at a predetermined position before the concave portion 16 reaches a position of the secondary transfer nip 13*a*. Therefore, when the concave portion 16 reaches a position, shown in FIG. 3A, slightly ahead of this transfer medium gripping starting position, the apical portion 20*a* of the transfer medium 20 which is fed from the gate roller 21 through a transfer medium supply guide 22 reaches a position opposite to the concave portion 16 as shown in FIG. 3A. The gripper 17 starts to be swung by the cam. When the concave portion 16 reaches the above-mentioned predetermined position, the gripper 17 is located at the transfer medium gripping starting position as shown in FIG. 3B, and grips the apical portion 20*a* of the transfer medium 20 between the gripper supporting portion 18 and the gripper. And then the transfer medium 20 is wrapped around the outer circumference plane of the elastic member 14*c* simultaneously with the rotation of the secondary transfer roller 14 and is moved to the secondary transfer nip 13*a*.

A transfer bias for transferring a toner image, transferred to the intermediate transfer belt 8, to the transfer medium 20 such as transfer paper is applied to the secondary transfer roller 14. The secondary transfer roller 14 is rotated in an arrow direction at the time of the rotation in an arrow direction of the intermediate transfer belt 8 as shown in FIG. 1 and the transfer bias is applied thereto, so that the toner image carried on the intermediate transfer belt 8 is transferred to the transfer medium 20 gripped by the gripper 17 through the secondary transfer nip 13*a*.

The secondary transfer roller cleaning section 15 removes liquid developer fixed to the elastic member 14*c* of the secondary transfer roller 14 by a cleaning member thereof, and recovers and stores the removed liquid developer in a liquid developer recovery container.

As shown in FIG. 1, the image forming apparatus 1 further includes a first airflow generating device 23, a second airflow generating device 24 which is an airflow generating unit, a transfer medium transporting section 25, a third airflow generating device 26, and a fixing section 27, in the position which is directed to the transfer medium transport direction from the secondary transfer nip 13*a* at the upward position of the intermediate transfer belt 8.

The transfer medium 20 passing through the secondary transfer nip 13*a* is released from the gripping caused by the gripper 17. As shown in FIG. 2, a transfer medium releasing position $\epsilon$ which is a position of the concave portion 16 at which this gripper 17 releases the transfer medium 20 (more particularly, a position of a substantial intersection point of the virtual straight line $\gamma$ linking the center of the gripper supporting portion 18 in the outer circumferential direction of the secondary transfer roller 14 and the rotational center 14*d* of the secondary transfer roller 14, and the virtual circle $\delta$ having the same diameter as that of the outer circumference of the secondary transfer roller 14) is located in the moving direction (the image forming unit side; the left side in FIG. 2) of the transfer medium 20 from a secondary transfer nip termination position $\zeta$ of the secondary transfer nip 13*a* of the transfer medium moving direction (in other words, located at the left side from the virtual vertical line $\alpha$), and is located at the image forming unit side (the lower side in FIG. 2) from the virtual vertical line $\beta$. In that case, the secondary transfer nip termination position $\zeta$ is a position at which the transfer medium 20 is separated from the intermediate transfer belt 8. Therefore, the transfer medium releasing position $\epsilon$ and the secondary transfer nip termination position $\zeta$ of the secondary transfer nip 13*a* are all located within the third quadrant formed by the virtual vertical line $\alpha$ and the virtual horizontal line $\beta$. When the gripping portion of the transfer medium 20 through the gripper 17 reaches a position slightly ahead of this transfer medium releasing position $\epsilon$, the gripper 17 starts to be swung by the cam. When the gripping portion of the transfer medium 20 through the gripper 17 reaches the transfer medium releasing position $\epsilon$, the gripper 17 is located at the transfer medium gripping releasing position as shown in FIG. 2, and releases the gripping of the apical portion 20*a* of the transfer medium 20. Thereby, the transfer medium 20 is released.

Figure 3C:
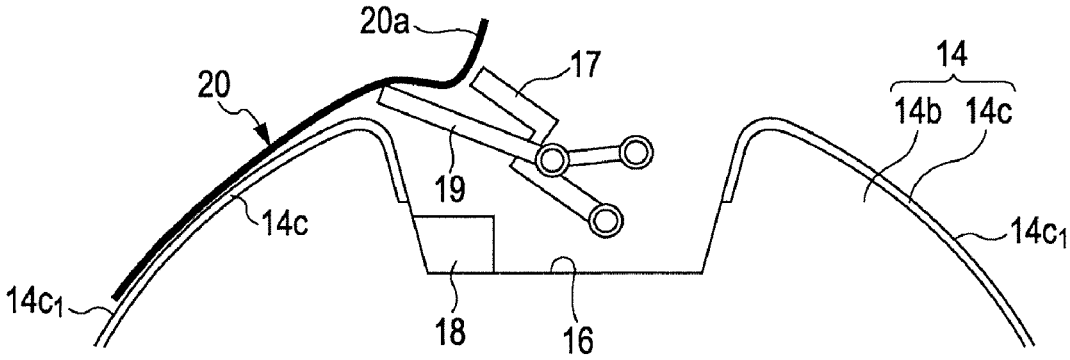
FIG. 3C is a diagram illustrating a protruding state after the gripping of the apical portion of the transfer medium is released.

Substantially simultaneously with the release of the transfer medium 20 through this gripper 17, the protruding claw 19 starts to be moved by the cam. As shown in FIG. 3C, the protruding claw 19 is protruded from the concave portion 16 of the secondary transfer roller 14 and is located at a protruding position while protruding the rear surface (surface of the opposite side of the transfer image plane) of the transfer medium 20. Thereby, the transfer medium 20 is detached from the secondary transfer roller 14, and is moved to the second airflow generating device 24 side as shown by the dotted lines in FIG. 4. The gripper 17 is received within the concave portion 16 when it is located at a predetermined position after the release of the transfer medium 20 by the cam, and is located at the transfer medium gripping releasing position when it is located at a predetermined position ahead of the transfer medium gripping starting position by the cam. In addition, the protruding claw 19 is received within the concave portion 16 when it is located at a predetermined position after the protrusion of the transfer medium 20 by the cam. That is, the gripper 17 and the protruding claw 19 operate without interference (contact) of the second airflow generating device 24.

As shown in FIG. 1, the first airflow generating device 23 has a duct-like air sending member 23*a* and an airflow generating portion 23*b* such as a fan (for example, a sirocco fan). The airflow is generated in the air sending member 23*a* by the driving of the airflow generating portion 23*b*, and the air is discharged from an air sending port 23*c* of the air sending member 23*a*.

As shown in FIG. 1, the second airflow generating device 24 is a suction guide portion of the invention, and has a duct-like suction member 24*a* and an airflow generating portion (airflow generating unit) 24*b* which is a suction unit such as a fan (for example, a sirocco fan). The suction member 24*a* has a guide plane $\mathbf{24}a_1$ provided with a predetermined number of suction holes which are not shown. This guide plane $\mathbf{24}a_1$ has an inclined plane directed to the top left obliquely from the bottom right in FIG. 1 and FIG. 2. By the driving of the airflow generating portion 24*b*, the suction member 24*a* suctions the air in a direction shown in an arrow contrary to gravity through each of the suction holes to thereby generate the airflow. As shown by the dotted lines in FIG. 4, the transfer medium 20 detached from the secondary transfer roller 14 is bent substantially at the transfer medium releasing position $\epsilon$, and is guided along the guide plane $\mathbf{24}a_1$ of the suction member 24*a* while the rear surface thereof is suctioned vertically obliquely upward by the airflow which the second airflow generating device 24 generates (vertically upward in a direction substantially perpendicular to the guide plane $\mathbf{24}a_1$).

The transfer medium transporting section 25 includes a transfer medium transporting belt 25*a*, a duct-like suction member 25*b*, and an airflow generating portion 25*c* such as a fan (for example, a sirocco fan). The transfer medium transporting belt 25*a* is formed of an endless belt having a large number of suction holes which are not shown, and is wound around three suspending rollers 25*d* (one of three suspending rollers 25*d* is a roller for driving the transfer medium transporting belt which rotates the transfer medium transporting belt 25*a*). The transfer medium transporting belt 25*a* is rotated in a direction (clockwise direction) shown by the arrows in FIG. 1, FIG. 2, and FIG. 4. The transfer medium transport direction of the transfer medium transporting belt portion in the transfer medium transporting belt 25*a* is inclined in a direction of the top left obliquely from the bottom right in FIG. 1 and FIG. 2. In this case, the inclination angle with respect to the horizon of the transfer medium transport direction in the transfer medium transporting belt 25*a* is the same, or substantially the same, as the inclination angle with respect to the horizon of the guide direction of the guide plane $\mathbf{24}a_1$ in the second airflow generating device 24.

Meanwhile, although the transfer medium transporting belt 25*a* is shown in FIG. 1 to be wound around three suspending rollers 25*d*, it can be configured so as to be wound around two or four or more suspending rollers 25*d*. The suction member 25*b* is located in the vicinity of the transport pathway of the transfer medium 20 and has a large number of suction holes 25$b_1$ in the opposite surface opposite to the transfer medium transporting belt 25*a*.

Figure 4:
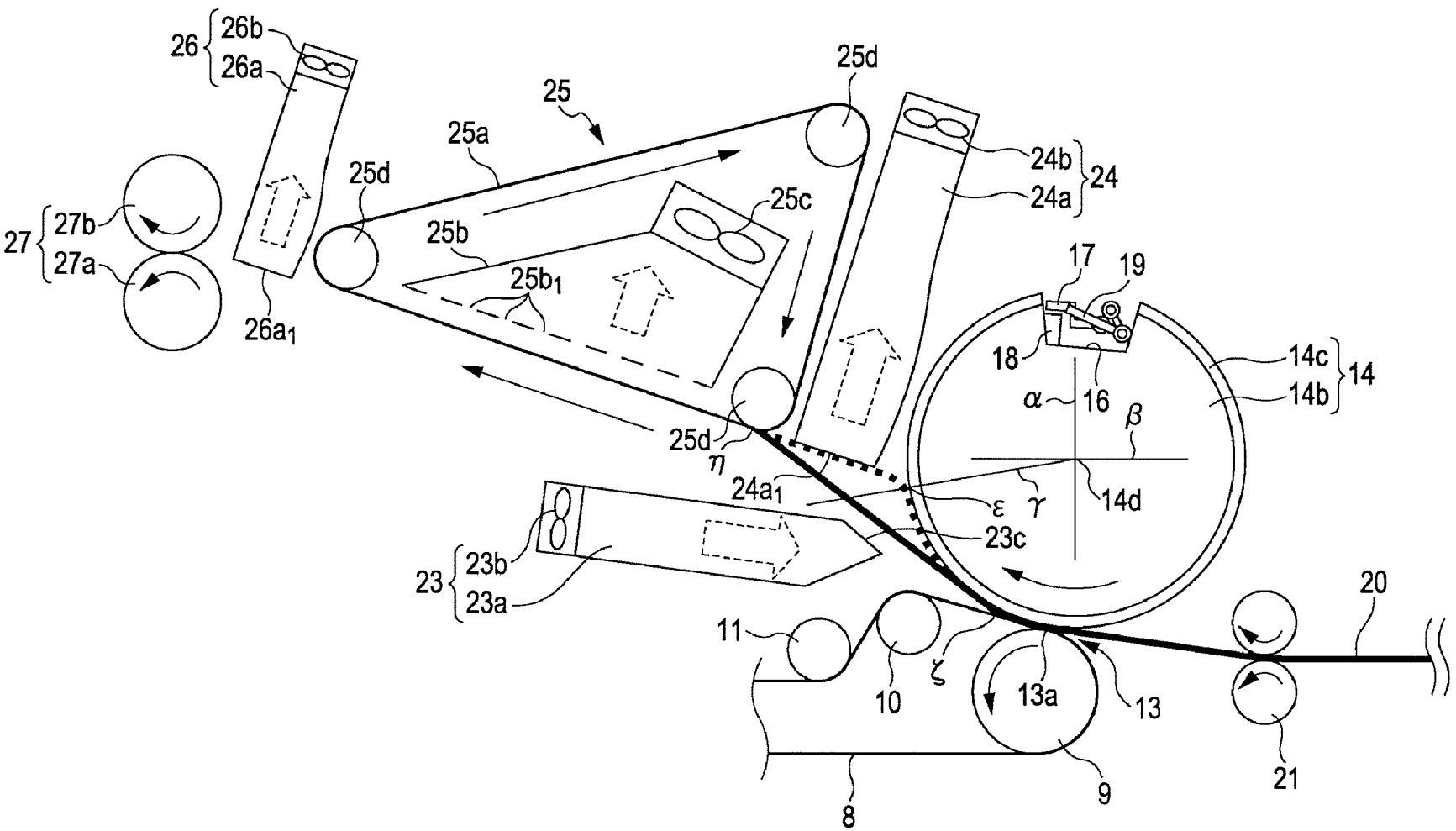
FIG. 4 is a diagram for explaining the transfer medium after the transfer medium transport release is moved along a virtually triangular moving pathway.

As shown in FIG. 4, a position at which the leading end of the transfer medium 20 suctioned and guided by the second airflow generating device 24 initially comes into contact with the transfer medium transporting belt 25*a* of the transfer medium transporting section 25 is set to a transfer medium transporting section starting point position η. This transfer medium transporting section starting point position η is a position at which the transfer medium transporting section 25 starts to suction the transfer medium 20. The transfer medium releasing position ϵ of the secondary transfer roller 14 and the secondary transfer nip termination position ζ of the secondary transfer nip 13*a* and the transfer medium transporting section starting point position η are disposed so as to form an approximately virtual triangle when viewed in a direction perpendicular, or substantially perpendicular, to the transfer medium moving direction.

Figure 5:
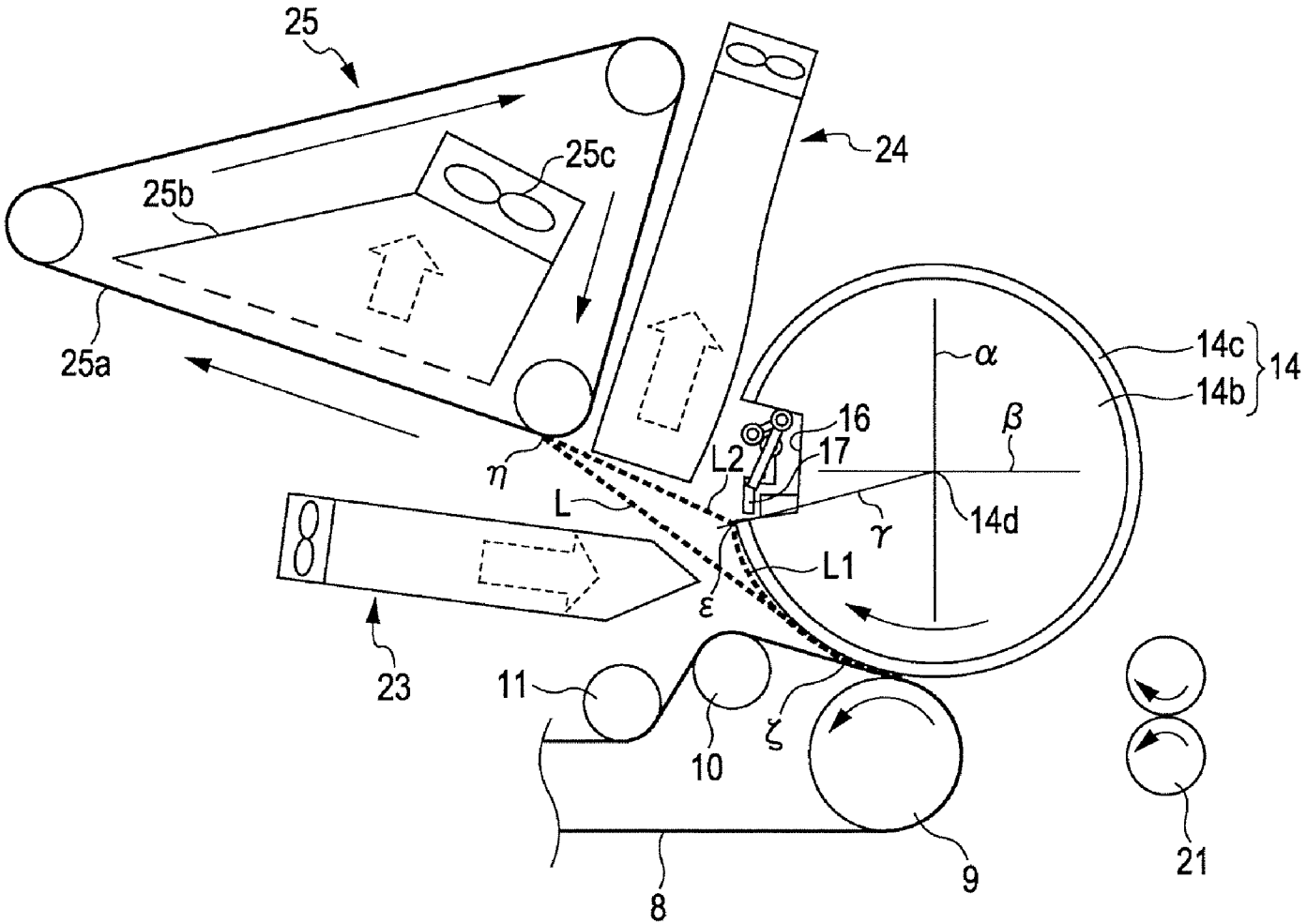
FIG. 5 is a diagram illustrating a position at which an image carrier and the transfer medium are separated from each other, a transfer medium releasing position, and a position at which a transfer medium transporting section starts to suction the transfer medium.

In that case, the length of each side of the approximately virtual triangle is defined as follows. Now, as shown in FIG. 5, the distance that links the secondary transfer nip termination position ζ at which the intermediate transfer belt 8 and the transfer medium 20 are separated from each other and the transfer medium releasing position ϵ at which the gripper 17 releases the transfer medium 20 is set to L1, where the distance, in other words, is substantially equivalent to the length of the side of the approximately virtual triangle between the secondary transfer nip termination position ζ and the transfer medium releasing position ϵ. In addition, the distance that links the transfer medium releasing position ϵ at which the gripper 17 releases the transfer medium 20 and the transfer medium transporting section starting point position η at which the transfer medium transporting section 25 suctions the transfer medium 20 is set to L2, where the distance, in other words, is substantially equivalent to the length of the side of the approximately virtual triangle between the transfer medium releasing position ϵ and the transfer medium transporting section starting point position η. Further, the distance that links the secondary transfer nip termination position ζ at which the intermediate transfer belt 8 and the transfer medium 20 are separated from each other and the position η at which the transfer medium transporting section 25 starts to suction the transfer medium 20 is set to L, where the distance, in other words, is substantially equivalent to the length of the side of the approximately virtual triangle between the secondary transfer nip termination position ζ and the transfer medium transporting section starting point position η. The distance L has the following relationship with respect to the other two distances L1 and L2.

$$L<L1+L2$$

In addition, it is preferable that this approximately virtual triangle is formed as an approximately obtuse triangle by an angle formed by the side between the secondary transfer nip termination position ζ and the transfer medium releasing position ϵ, and the side between the transfer medium releasing position ϵ and the transfer medium transporting section starting point position η for the purpose of smoothly transporting the transfer medium 20. In addition, the first airflow generating device 23 is arranged vertically downward from this approximately virtual triangle, and discharges air from the discharging port 23*c* vertically upward in a direction perpendicular, or substantially perpendicular, to the side of the approximately virtual triangle between the secondary transfer nip termination position ζ and the transfer medium transporting section starting point position η. The transfer medium 20 is moved from the bottom right to the top left in FIG. 1 and FIG. 2, that is, from the secondary transfer nip termination position ζ substantially through the transfer medium releasing position ϵ toward the transfer medium transporting section starting point position η along the moving pathway of two sides of the approximately virtual triangle shown by the dotted line.

By the driving of the airflow generating portion 25*c*, the suction member 25*b* suctions the air in a direction shown by the arrow contrary to gravity through the suction holes of the transfer medium transporting belt 25*a* and the suction holes 25$b_1$ of the suction member 25*b* to thereby generate the airflow. When the leading end of the transfer medium reaches the transfer medium transporting section starting point position η, the transfer medium 20 is transported to the third airflow generating device 26 by the transfer medium transporting belt 25*a*, while the rear surface of the transfer medium is suctioned vertically obliquely upward by the airflow generated by the suction member 25*b* (upward in the vertical direction and the direction substantially perpendicular to the inclined direction of the transfer medium transporting belt portion in the transfer medium transporting belt 25*a*). In that case, even when the transfer medium 20 is suctioned to the transfer medium transporting belt 25*a* in a direction contrary to gravity, the transfer medium 20 is suctioned more effectively, and is moved along with the transfer medium transporting belt 25*a*.

Figure 6:
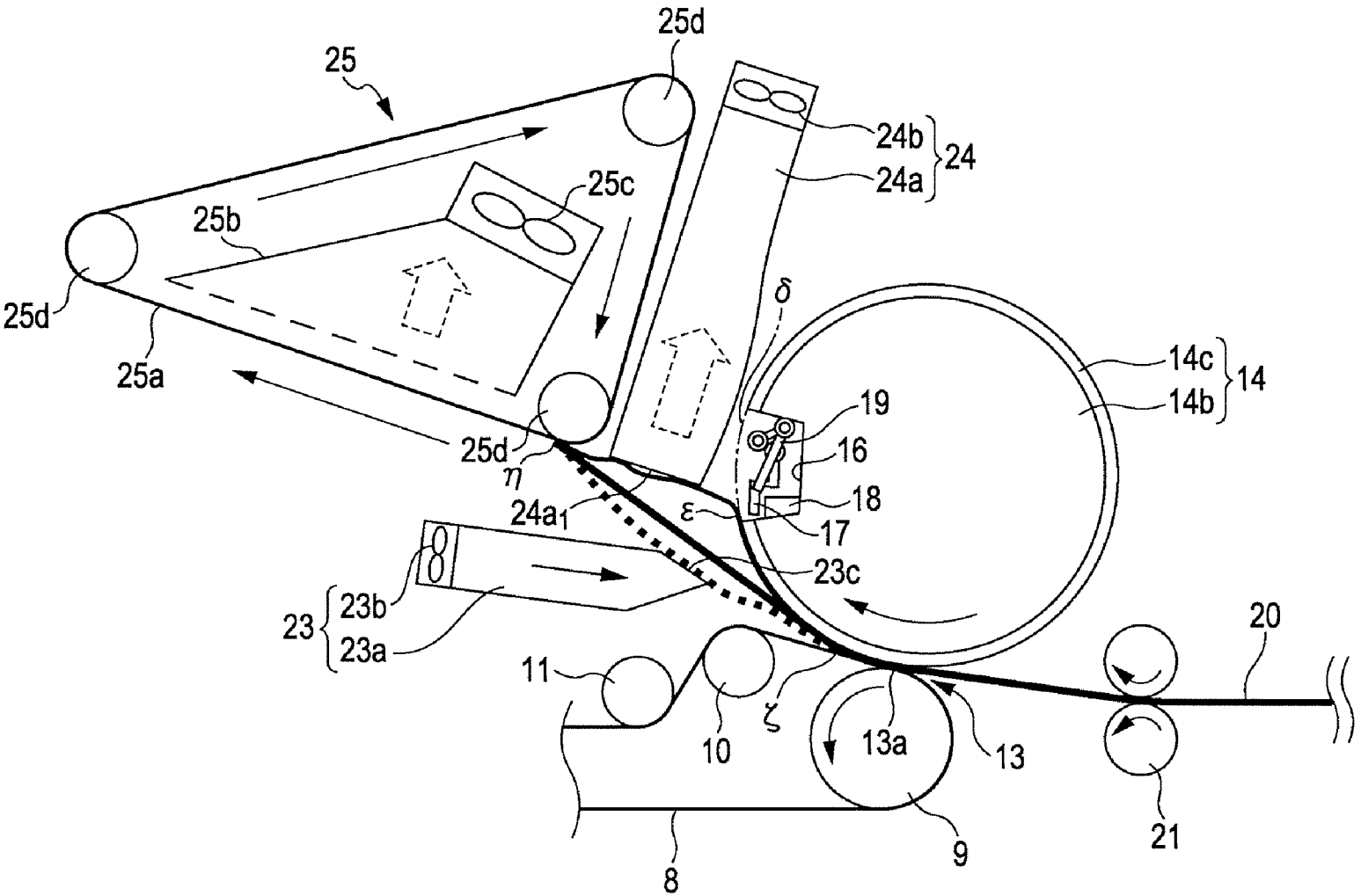
FIG. 6 is a diagram for explaining that the image plane of the transfer medium contacts a member disposed downward by the looseness of the transfer medium after the transfer.
Figure 7:
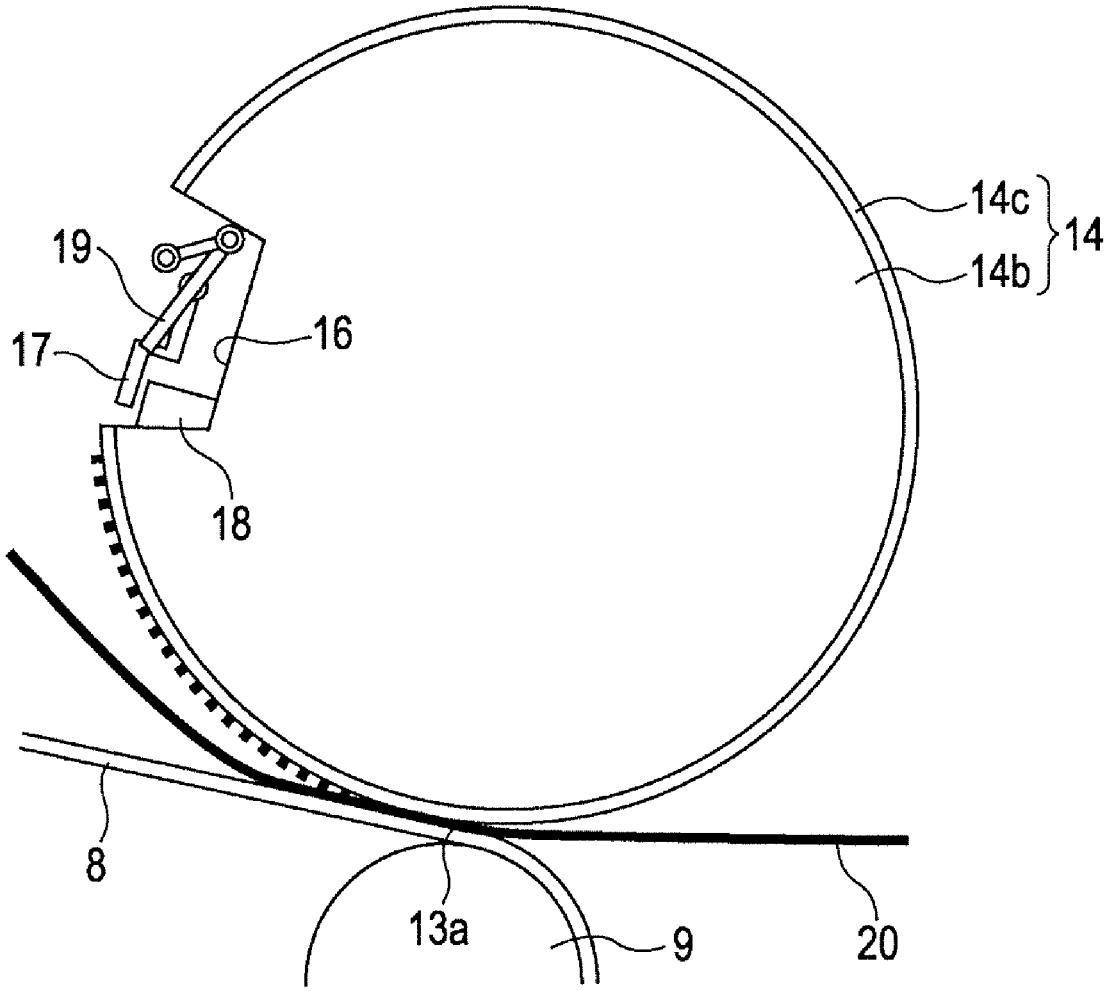
FIG. 7 is a diagram for explaining how the image plane of the transfer medium contacts the intermediate transfer belt again through the looseness of the transfer medium after the transfer.

When the transport of the transfer medium 20 by the transfer medium transporting belt 25*a* starts, the transfer medium 20 passing through the secondary transfer nip 13*a*, as mentioned above, is bent downward due to its own weight using the transfer medium transporting section starting point position η and the secondary transfer nip termination position ζ of the secondary transfer nip 13*a*, respectively, as a supporting point. Then, the transfer medium 20 is moved substantially along the approximately linear moving pathway, shown in the solid line in FIG. 4, that links the transfer medium transporting section starting point position η and the secondary transfer nip termination position ζ of the secondary transfer nip 13*a*. For this reason, the moving pathway of the transfer medium 20 is changed in a short distance. When the transfer medium 20 is further loosened and is bent downward, there occurs the above-mentioned problem that the transfer image plane of the transfer medium 20 before being fixed contacts the first airflow generating device 23 as shown in FIG. 6, or the transfer image plane of the transfer medium 20 before being fixed contacts the intermediate transfer belt 8 again as shown in FIG. 7.

Therefore, in the image forming apparatus 1 of this example, the transfer medium 20 passing through the secondary transfer nip 13*a* is suppressed from being greatly bent downward by the second airflow generating device 24, and the transfer image plane of the transfer medium 20 is prevented from contacting another member of the image forming apparatus disposed downward from the moving pathway of the transfer medium 20.

Figure 8:
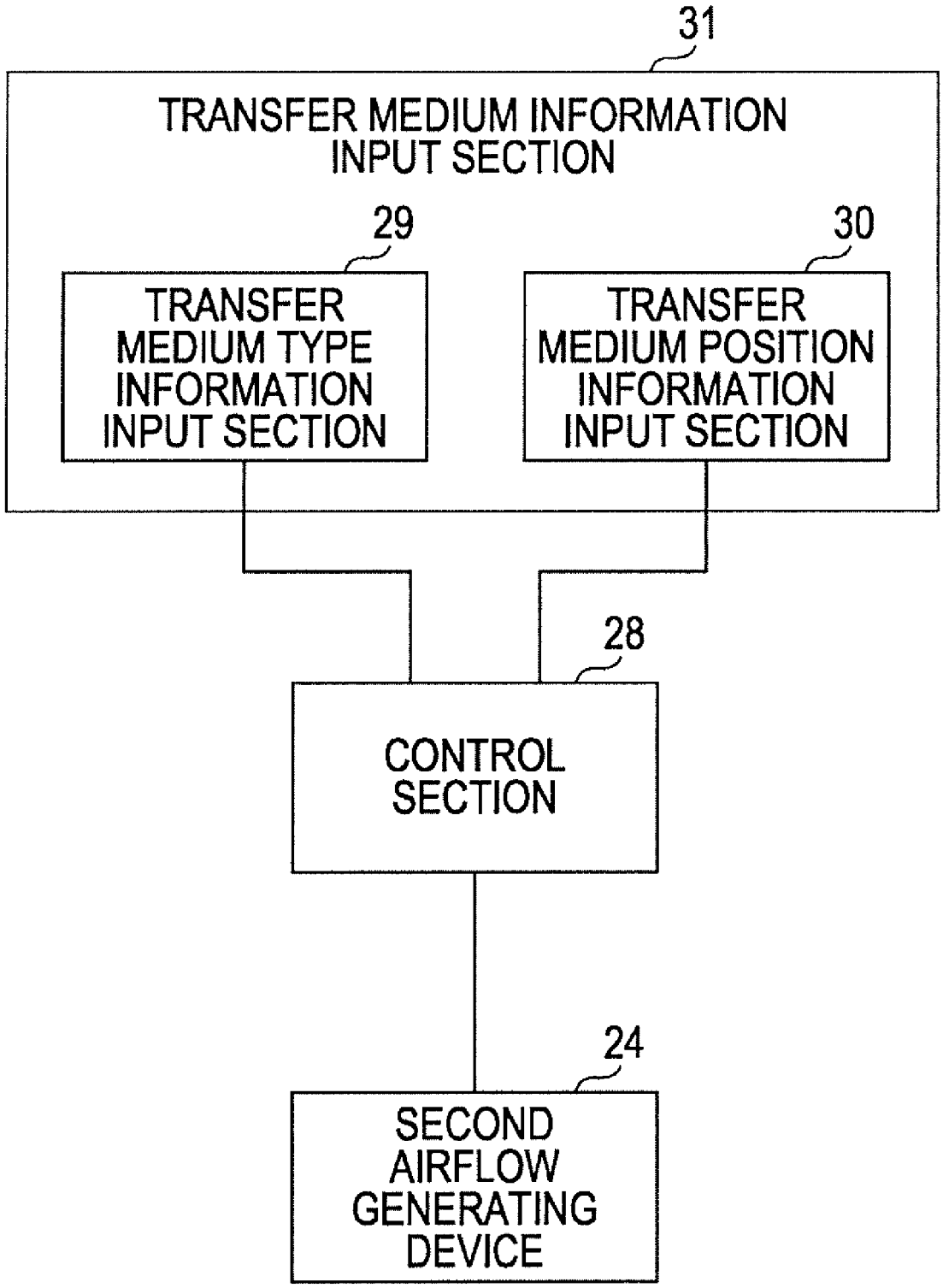
FIG. 8 is a block diagram of the control of a second airflow generating device.
Figure 9:
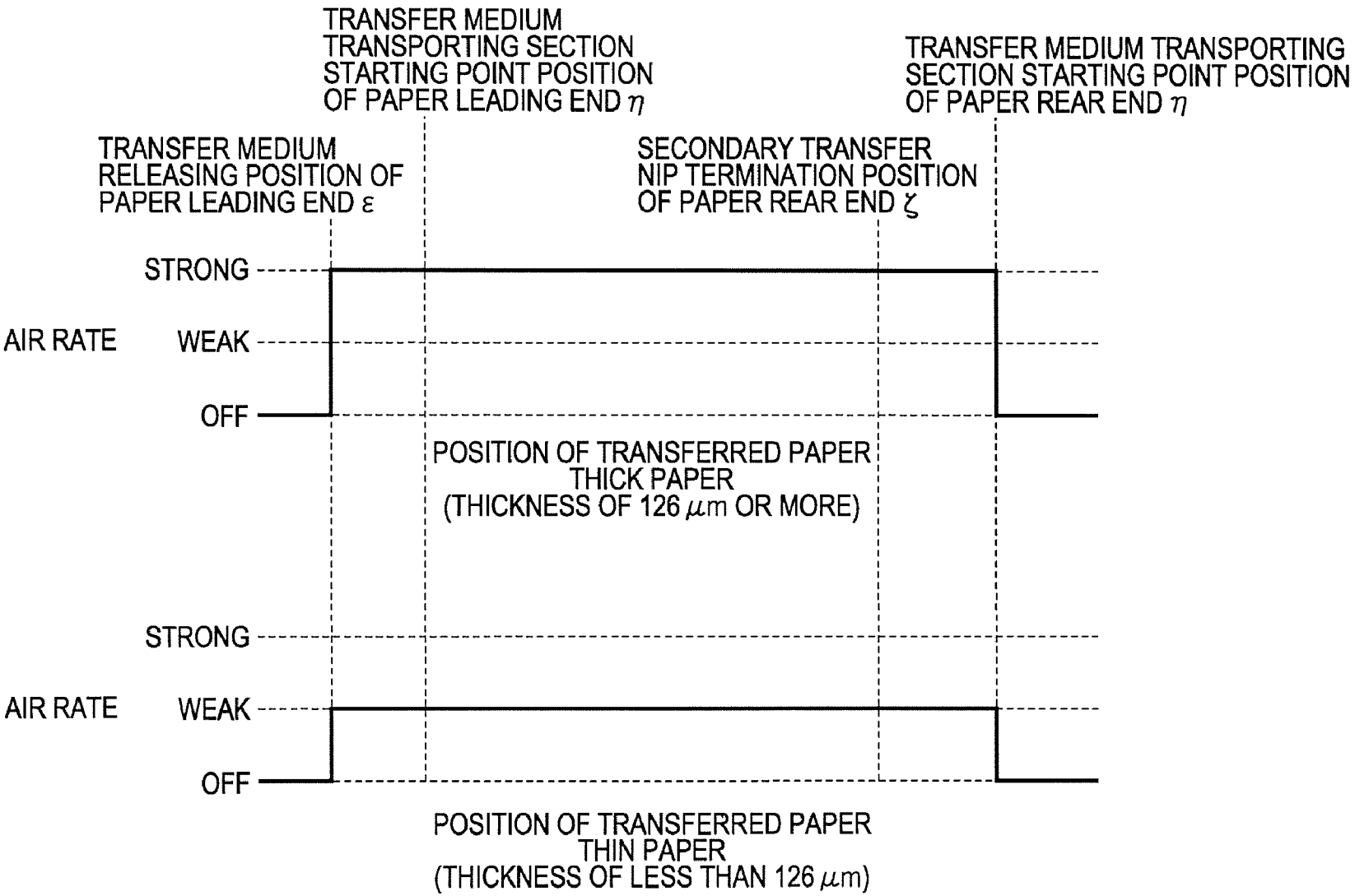
FIG. 9 is a diagram illustrating a timing chart of the control of the second airflow generating device.

FIG. 8 is a block diagram of the control of the second airflow generating device, and FIG. 9 is a timing chart of the control of the second airflow generating device.

As shown in FIG. 8, the second airflow generating device 24 is controlled by a control section 28 of the image forming apparatus 1. A transfer medium information input section 31, including a transfer medium type information input section 29 and a transfer medium position information input section 30, to which information on the transfer medium 20 is input is connected to this control section 28.

The transfer medium type information input section 29 is configured such that information on the size (for example, A4 width, A4 length, B5, B4 and the like) of the transfer medium 20 to be used and the thickness (basis weight) of the transfer medium 20 is input thereto, and the information is output to the control section 28. This transfer medium type information input section 29 is arranged as a transfer medium type setting section such as an operation key in an image forming operation panel of the image forming apparatus 1. Meanwhile, it is possible to use a measuring instrument or an ultrasonic detector and the like for detecting the thickness (basis weight) of the transfer medium 20 separately without being limited thereto.

In addition, the transfer medium position information input section 30 is configured such that information on the transport position of the transfer medium 20 (in other words, the movement position of the transfer medium 20) is input thereto, and the information is output to the control section 28. In that case, the transport position of the transfer medium 20 is equivalent to each position of the leading end and the rear end of the transfer medium 20. This transport position of the transfer medium 20 is detected by a transport position detecting unit which is not shown, and information on the transport position of the transfer medium 20 detected by the transport position detecting unit is input to the transfer medium position information input section 30. This transport position detecting unit is arranged as a mechanical or optical rotational position detector for detecting the rotational position of the secondary transfer roller 14 corresponding to the transfer medium releasing position $\epsilon$. Meanwhile, it is possible to use a detector for detecting an operation (change of position) of the gripper 17, or a timer for measuring the time when the leading end of the transfer medium 20 takes from the position of the secondary transfer nip 13*a* to the transfer medium releasing position $\epsilon$, without being limited thereto.

The control section 28 controls the flow rate of the airflow (in other words, air suction rate) of the second airflow generating device 24 that suctions the transfer medium 20, in response to the thickness (basis weight) of the transfer medium 20 and the transport position of the transfer medium 20 after passing through the secondary transfer nip 13*a*. In that case, when information on the type of the transfer medium 20 input to the transfer medium type information input section 29 of the transfer medium information input section 31, for example, the thickness of the transfer medium 20 is equal to the first thickness, the control section 28 sets the flow rate of the airflow generated by the second airflow generating device 24 to the first flow rate. When the thickness of the transfer medium 20 is equal to the first thickness, the second airflow generating device 24 suctions the transfer medium 20 with the first suction power based on the first flow rate. In addition, when the thickness of the transfer medium 20 input to the transfer medium type information input section 29 of the transfer medium information input section 31 is equal to the second thickness larger than the above-mentioned first thickness, the control section 28 sets the flow rate of the airflow generated by the second airflow generating device 24 to the second flow rate larger than the first flow rate. When the thickness of the transfer medium 20 is equal to the second thickness, the second airflow generating device 24 suctions the transfer medium 20 with the second suction power based on the second flow rate larger than the first suction power.

For example, a description will be given of the case where transfer paper is used as the transfer medium 20. In this case, the control of strength and weakness of the flow rate of the airflow (suction air rate) of the second airflow generating device 24 is different depending on the paper thickness.

First, the lengths of the sides of the approximately virtual triangle mentioned above are assumed such that the length (distance L1) of the side between the secondary transfer nip termination position $\zeta$ and the transfer medium releasing position $\epsilon$ is 85 mm, the length (distance L2) of the side between the transfer medium releasing position $\epsilon$ and the transfer medium transporting section starting point position $\eta$ is 76 mm, and the length (distance L) of the side between the secondary transfer nip termination position $\zeta$ and the transfer medium transporting section starting point position $\eta$ is 150 mm. Therefore, the relationship of $L<L1+L2$ is satisfied. In this case, the sum of two sides of the approximately virtual triangle is 161 mm and the length of another side is 150 mm, and thus the difference between the sum of the lengths of two sides and the length of another side is 11 mm. In addition, all of each inclination angle (acute angle) with respect to the horizon of the transfer medium guide direction of the guide plane 24$a_1$ of the second airflow generating device 24 and the transfer medium transport direction of the transfer medium transporting belt 25*a* are approximately the same 25°.

In this example, a standard thickness of 126 μm is preset as a standard of determination of whether the transfer paper is thick paper or thin paper. That is, the transfer paper having a standard thickness of 126 μm or more is set to thick paper having the above-mentioned second thickness, and the transfer paper having a standard thickness of less than 126 μm is set to thin paper having the above-mentioned first thickness.

When the transfer paper is thick paper, and as shown in FIG. 9, the control section 28 determines that the paper leading end of the transfer paper passing through the secondary transfer nip 13*a* does not yet reach the transfer medium releasing position $\epsilon$ on the basis of output information from the transfer medium position information input section 30, it does not drive the second airflow generating device 24.

When the control section 28 determines that the paper leading end of the transfer paper reaches the transfer medium releasing position $\epsilon$ on the basis of the above-mentioned output information, it drives the airflow generating portion 24*b* of the second airflow generating device 24, when. Then, the second airflow generating device 24 generates the airflow and the suction member 24*a* suctions the air through each of the suction holes in a direction contrary to gravity shown by the arrows in FIG. 1 and FIG. 2. At this time, the control section 28 controls the air suction rate (air rate) of the second airflow generating device 24 with a strength (approximately 0.43 $m^3$/min or so) corresponding to the above-mentioned second flow rate. The reason that the air suction rate is controlled with the strength in this way is that when the apical portion of the transfer paper is released, the transfer paper of pressed paper increases in the bending thereof due to its own weight and stiffness of the thick paper is strong in order to suppress this bending, and thus the air rate is required to be strengthened. Thereby, when the transfer paper is thick paper, the second airflow generating device 24 suctions the transfer paper with the above-mentioned second suction power.

Further, when the control section 28 determines that the paper leading end of the transfer paper reaches the transfer medium transporting section starting point position $\eta$ on the basis of the above-mentioned output information, it maintains and controls the air suction rate of the second airflow generating device 24 with the above-mentioned strength as it is. The reason that the air suction rate is maintained and controlled with the strength in this way is that after the paper leading end reaches the transfer medium transporting section starting point position $\eta$ as mentioned above, the transfer paper tends to be moved to the linear moving pathway substantially along another side of the approximately virtual triangle due to its own weight, but the transfer paper is sufficiently suctioned to the guide plane 24$a_1$ side by setting the air suction rate at strength because of the strong stiffness of the thick paper, to thereby allow it to be moved while the looseness thereof is suppressed. Until the rear end of the transfer paper passes through the secondary transfer nip termination position ζ of the secondary transfer nip 13*a*, the attitude of the transfer paper is substantially constantly held by maintaining the air suction rate of the second airflow generating device 24 with the strength. Thereby, a tiny change in the width of the secondary transfer nip 13*a* (length of the secondary transfer nip 13*a* in the moving direction of the transfer medium 20) becomes small, and thus small image deviation is suppressed.

Further, when the control section 28 determines that the paper rear end of the transfer paper is located at the secondary transfer nip termination position ζ of the secondary transfer nip 13*a* on the basis of the above-mentioned output information, the air suction rate of the second airflow generating device 24 is maintained and controlled with the above-mentioned strength as it is. The reason that the air suction rate is maintained and controlled at strength in this way is that since there is a concern that the paper rear end of the transfer paper becomes free and the rear end portion of the paper is bent due to the weight of the thick paper to thereby contact the members of the image forming apparatus 1, the air rate is required to be strengthened.

Finally, when the control section 28 determines the paper rear end of the transfer paper reaches the transfer medium transporting section starting point position η on the basis of the above-mentioned output information, it stops the driving of the second airflow generating device 24, and turns off the air suction by the second airflow generating device 24.

On the other hand, when the transfer paper is thin paper, and the control section 28 determines that the paper leading end of the transfer paper passing through the secondary transfer nip 13*a* does not yet reach the transfer medium releasing position ϵ on the basis of the above-mentioned output information, it does not drive the second airflow generating device 24 similarly to the case of the thick paper mentioned above.

When the control section 28 determines that the paper leading end of the transfer paper reaches the transfer medium releasing position ϵ on the basis of the above-mentioned output information, it drives the airflow generating portion 24*b* of the second airflow generating device 24. Then, similarly to the above, the second airflow generating device 24 generates the airflow, and the suction member 24*a* suctions the air through each of the suction holes of the guide plane 24$a_1$. At this time, the control section 28 controls the air suction rate of the second airflow generating device 24 with a weakness (approximately 0.20 $m^3$/min) corresponding to the above-mentioned first flow rate. The reason that the air suction rate is controlled weakly in this way is that the stiffness of the thin paper moved by the rotation of the secondary transfer roller 14 is weak, and thus when the apical portion of paper is released, the transfer paper obtains a sufficient suction effect even at a weak air suction rate and is not subject to being bent downward, to thereby allow the transfer paper to be guided and moved while it is adequately suctioned to the guide plane 24$a_1$. When the air suction rate is controlled with the weakness mentioned above, the mobility of the transfer paper moved only by the rotation of the secondary transfer roller 14 is lowered due to strong holding power of the transfer paper onto the guide plane 24$a_1$. Thereby, when the transfer paper is thin paper, the second airflow generating device 24 suctions the transfer paper with the above-mentioned first suction power.

Further, even when the control section 28 determines that the paper leading end of the transfer paper reaches the transfer medium transporting section starting point position η on the basis of the above-mentioned output information, the air suction rate of the second airflow generating device 24 is maintained with the above-mentioned weakness. The reason that the air suction rate is maintained and controlled weakly in this way is that in the case of the thin paper its own weight is low, and thus after the paper leading end reaches the transfer medium transporting section starting point position η, the transfer paper is not greatly bent downward, to thereby allow the transfer paper to be moved while it is adequately suctioned to the guide plane 24$a_1$ side. Even when the air suction rate is controlled weakly, the attitude of the transfer paper is substantially constantly held. Thereby, a tiny change in the width of the secondary transfer nip 13*a* becomes small, and thus small image deviation is suppressed.

Further, even when the control section 28 determines that the paper rear end of the transfer paper passes through the secondary transfer nip termination position ζ of the secondary transfer nip 13*a* on the basis of the above-mentioned output information, the air suction rate of the second airflow generating device 24 is maintained with the above-mentioned weakness. The reason that the air suction rate is maintained and controlled weakly in this way is that since the paper rear end of the transfer paper passes through the secondary transfer nip 13*a* and then becomes free, the transfer paper located at the rear end side from the transfer medium transporting section starting point position η is greatly bent and does not tend to be moved to the moving pathway of another side of the approximately virtual triangle, to thereby allow it to be moved more stably at the second airflow generating device 24 side than at the other side, and thus the air suction rate is not required to be set to strong.

Finally, when the control section 28 determines that the paper rear end of the transfer paper reaches the transfer medium transporting section starting point position η on the basis of the above-mentioned output information, it stops the driving of the second airflow generating device 24, and turns off the air suction by the second airflow generating device 24.

The third airflow generating device 26 includes a duct-like suction member 26*a* and an airflow generating portion 26*b* such as a fan. The suction member 26*a* includes a guide plane 26$a_1$ having a predetermined number of suction holes which are not shown. The suction holes of the guide plane 26$a_1$ are arranged similarly, or substantially similarly, to the suction holes of the second airflow generating device 24 mentioned above.

By the driving of the airflow generating portion 26*b*, the suction member 26*a* suctions the air through each of the suction holes of the guide plane 26$a_1$ in a direction shown by the arrow to generate the airflow. The transfer medium 20 transported from the transfer medium transporting belt 25*a* is guided to the fixing section 27 side along the guide plane 26$a_1$, while the rear surface thereof is suctioned vertically obliquely upward by the suction member 26*a*.

The fixing section 27 has a fixing roller including a heating roller 27*a* and a pressure roller 27*b* which comes into press-contact with this heating roller 27*a*. The toner image of the transfer medium 20 is heated and pressurized and thus fixed by the heating roller 27*a* and the pressure roller 27*b*. After that, the transfer medium is discharged to a discharge tray which is not shown.

Another configuration and another image forming operation of the image forming apparatus 1 of this example are the same as those of the hitherto known image forming apparatus of the same type in which liquid developer is used, and thus a description thereof will be omitted.

According to the image forming apparatus 1 and the image forming method of this example, the apical portion 20*a* of the transfer medium 20 is gripped by the gripper 17, the image of the intermediate transfer belt 8 is transferred to the transfer medium 20 by the secondary transfer nip 13*a*, and after the secondary transfer the gripping of the apical portion 20*a* by the gripper 17 is released at the transfer medium releasing position ϵ and the transfer medium 20 is released. Next, the transfer medium 20 is guided from the vertically downward position to the obliquely upward position toward the transfer medium transporting section 25 while it is suctioned by the guide plane 24$a_1$ of the second airflow generating device 24, and the leading end of the transfer medium 20 reaches the transfer medium transporting section starting point position η. At this time, the secondary transfer nip termination position ζ of the secondary transfer nip 13*a*, the transfer medium releasing position ϵ, and the transfer medium transporting section starting point position η of the transfer medium transporting belt 25*a* with which the leading end of the transfer medium 20 initially comes into contact are disposed in an approximately virtual triangle when viewed from a direction perpendicular, or substantially perpendicular, to the transfer medium moving direction. When the distance that links the secondary transfer nip termination position ζ and the transfer medium transporting section starting point position η of the transfer medium transporting section 25 is set to L, the distance that links the secondary transfer nip termination position ζ and the transfer medium releasing position ϵ is set to L1, and the distance that links the transfer medium releasing position ϵ and the transfer medium transporting section starting point position η is set to L2, L has a relationship of L<L1+L2 with respect to L1 and L2. Therefore, when the leading end of the transfer medium 20 reaches the transfer medium transporting section starting point position η, the transfer medium 20 is bent downward due to its own weight using the secondary transfer nip termination position ζ and the transfer medium transporting section starting point position η as a supporting point, and is moved on the moving pathway substantially along another side of the approximately virtual triangle between the secondary transfer nip termination position ζ and the transfer medium transporting section starting point position η. For this reason, the length of the moving pathway of the transfer medium 20 is reduced from L1+L2 to L. Consequently, the transfer medium 20 can be located at the guide plane 24$a_1$ side rather than at another side of the approximately virtual triangle by controlling the air suction of the second airflow generating device 24 in the control section 28. Thereby, it is possible to reduce a change in the length of the moving pathway of the transfer medium 20, and to suppress the looseness of the transfer medium 20 caused by this change in the length. Therefore, it is possible to prevent the transfer image plane of the transfer medium 20 passing through the secondary transfer nip 13*a* from contacting the members of the image forming apparatus 1, such as the intermediate transfer belt 8 or the first airflow device 23, which are arranged under the moving pathway of the transfer medium 20. As a result, it is possible to prevent disarray of the transferred image. In addition, since the looseness of the transfer medium 20 is reduced, it is possible to reduce a change in the width of the secondary transfer nip 13*a* caused by a tiny change in the transfer attitude of the transfer medium 20, and to suppress the generation of image deviation. In this way, even when the secondary transfer nip termination position ζ of the secondary transfer nip 13*a*, the transfer medium releasing position ϵ, and transfer medium transporting section starting point position η are disposed in an approximately virtual triangle in performing the secondary transfer in a state of gripping the transfer medium 20, it is possible to realize the image forming apparatus 1 capable of obtaining a good image.

In particular, when the thickness of the transfer medium 20 input to the transfer medium information input section 31 is the first thickness smaller than the preset standard thickness, the control section 28 sets the flow rate of the airflow generated by the airflow generating portion 24*b* of the second airflow generating unit 24 to the above-mentioned weakness, and when the thickness of the transfer medium 20 input to the transfer medium information input section 31 is the second thickness equal to or more than the preset standard thickness, the control section 28 sets the flow rate of the airflow generated by the airflow generating portion 24*b* of the second airflow generating unit 24 to the above-mentioned strength. That is, the control section 28 selectively controls the suction power of the suction member 24*a* of the second airflow generating device 24 with either of the first suction power by the first flow rate or the second suction power by the second flow rate larger than the first suction power on the basis of information on the thickness of the transfer medium 20. Thereby, it is possible to more reliably prevent the transfer image plane of the transfer medium 20 passing through the transfer nip 13*a* from contacting the members of the image forming apparatus 1 which are arranged under the moving pathway of the transfer medium 20 mentioned above in response to the thickness of the transfer medium.

In addition, the control section 24 controls the suction of the airflow generating portion 24*b* of the second airflow generating device 24 on the basis of the transport position of the transfer medium 20 detected by the transport position detecting unit. Thereby, it is possible to efficiently control the suction of the airflow generating portion 24*b*, and to more reliably perform suction guidance of the transfer medium 20 by the second airflow generating device 24.

Figure 10:
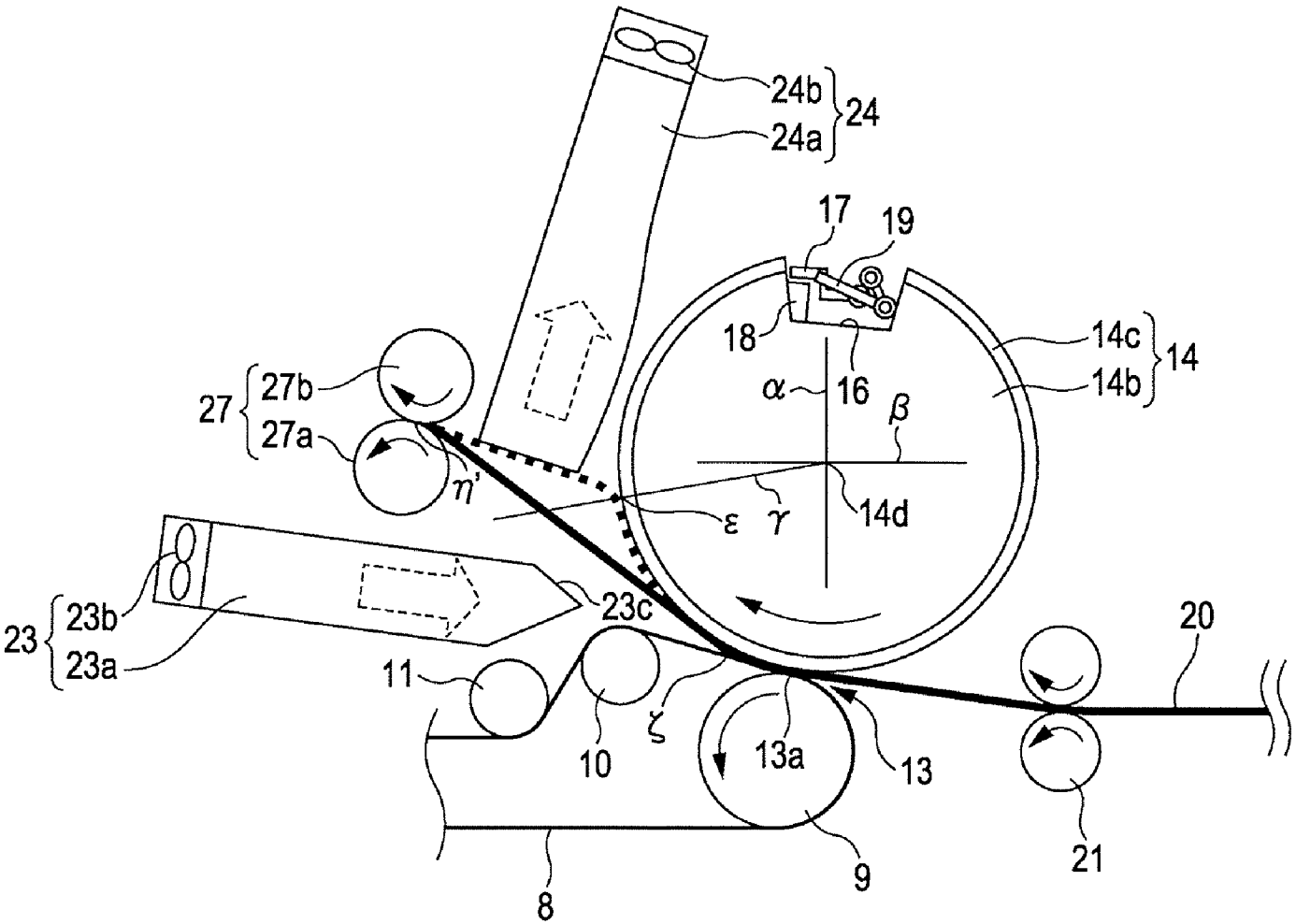
FIG. 10 is the same diagram as FIG. 2, partially illustrating another example of the embodiment of the image forming apparatus according to the invention.

FIG. 10 is the same diagram as FIG. 2 partially illustrating another example of the embodiment of the image forming apparatus according to the invention.

In the example of the embodiment mentioned above, the transfer medium 20 passing through the secondary transfer nip 13*a* is transported to the fixing section 27 side by the transfer medium transporting belt 25*a* used as a transfer medium transporting member. However, in the image forming apparatus 1 of this example, the transfer medium transporting member is constituted by the heating roller 27*a* and the pressure roller 27*b* of the fixing section 27 as shown in FIG. 10. In other words, the heating roller 27*a* and the pressure roller 27*b* have both the fixing function of the transfer medium 20 and the transport function of the transfer medium 20. Therefore, in the image forming apparatus 1 of this example, the transfer medium transporting section 25 and the third airflow generating device 26 of the above-mentioned example are not provided. In the image forming apparatus 1 of this example, the transfer medium transporting section starting point position η of the above-mentioned example corresponds to the transfer medium transporting section starting point position η' at which the leading end of the transfer medium 20 initially comes into contact with the pressure roller 27*b*. Even in the image forming apparatus 1 of this example, the transfer medium releasing position ϵ, the transfer medium transporting section starting point position η' of the fixing section 27, and the secondary transfer nip termination position ζ are disposed in an approximately virtual triangle.

According to the image forming apparatus 1 and the image forming method of this example, since the fixing section 27 is used as a transfer medium transporting section, it is possible to eliminate the need for the transfer medium transporting section 25 and the third airflow generating device 26, and to form the whole configuration in a compact manner.

Other configurations and operational advantages of the image forming apparatus 1 of this example are the same as those of the above-mentioned example.

Meanwhile, the transfer medium transporting device and the image forming apparatus of the invention are not limited to each of the examples of the embodiment mentioned above. For example, the first airflow generating portion 23 as shown in FIG. 1 is not necessarily needed, but can be omitted.

In addition, although the intermediate transfer belt 8 is used as an image carrier, an intermediate transfer drum can also be used, and a photoreceptor can be used as an image carrier. When the photoreceptor is used in the image carrier, it goes without saying that the toner image of the photoreceptor is directly transferred to the transfer medium. Further, although the image forming apparatus of each of the examples mentioned above is used as a tandem-type image forming apparatus, it may be another type of image forming apparatus, and may be a monochromatic image forming apparatus. In short, the invention can implement various design changes within the scope of the claims.

The entire disclosure of Japanese Patent Application No: 2009-264607, filed Nov. 20, 2009 is expressly incorporated by reference herein.

What is claimed is:

1. An image forming apparatus comprising:

an image carrier that carries an image;

a transfer roller that includes a gripping member for gripping or releasing a transfer medium, and transfers the image carried on the image carrier to the transfer medium through a transfer nip formed in contact with the image carrier via the transfer medium;

a suction guide portion that includes a suction unit for suctioning the transfer medium released from the gripping member, and suctions and guides the transfer medium transferred the image, vertically upward through the suction unit with a plane transferred the image of the transfer medium being directed vertically downward; and a transfer medium transporting section that includes a suction member for suctioning the transfer medium guided by the suction guide portion and transports the transfer medium while suctioning the transfer medium by the suction member, the transfer medium transporting section being configured such that a position of starting to suction the transfer medium is arranged at a position having the following relationship with respect to a position of releasing the transfer medium from the gripping member and a position at which the image carrier is separated from the transfer medium:

$$L<L1+L2$$

where L is a distance that links the position at which the image carrier and the transfer medium are separated from each other, and the position at which the transfer medium transporting section starts to suction the transfer medium, L1 is a distance that links the position at which the image carrier and the transfer medium are separated from each other, and the position at which the gripping member releases the transfer medium, and L2 is a distance that links the position at which the gripping member releases the transfer medium, and the position at which the transfer medium transporting section starts to suction the transfer medium.

2. The image forming apparatus according to claim 1, further comprising a control section that controls suction power of the suction unit of the suction guide portion.

3. The image forming apparatus according to claim 2, further comprising:

a transfer medium information input section to which a transfer medium information is input, wherein the control section controls suction power of the suction unit of the suction guide portion on the basis of the transfer medium information input to the transfer medium information input section.

4. The image forming apparatus according to claim 3, wherein the transfer medium information is a information on a thickness of the transfer medium, the suction unit of the suction guide portion is an airflow generating unit that generates airflow, when the transfer medium information input to the transfer medium information input section is a first thickness, the control section sets the flow rate of the airflow generated by the airflow generating unit to a first flow rate, and when the transfer medium information input to the transfer medium information input section is a second thickness larger than the first thickness, the control section sets the flow rate of the airflow generated by the airflow generating unit to a second flow rate larger than the first flow rate.

5. The image forming apparatus according to claim 3, further comprising:

a transport position detecting unit that detects a transport position of the transfer medium, wherein the transfer medium information is information on the transport position of the transfer medium, and the control section controls the suction power of the suction unit of the suction guide portion on the basis of the transfer medium information detected by the transport position detecting unit.

6. An image forming method comprising:

gripping a transfer medium by a gripping member arranged in a circumferential surface of a transfer roller, transporting the transfer medium gripped by the gripping member to a transfer nip formed by an image carrier and the transfer roller and transferring an image carried on the image carrier to the transfer medium, releasing the transfer medium to which the image is transferred from the gripping member by moving the gripping member, after the image is transferred to the transfer medium, suctioning and guiding the released transfer medium vertically upward by a suction guide portion with a plane transferred the image of the transfer medium being directed vertically downward, and suctioning and transporting the suctioned and guided transfer medium by a transfer medium transporting section configured such that a position of starting to suction the transfer medium is arranged at a position having the following relationship:

$$L<L1+L2$$

where L is a distance that links a position at which the image carrier and the transfer medium are separated from each other, and a position at which the transfer medium transporting section starts to suction the transfer medium, L1 is a distance that links the position at which the image carrier and the transfer medium are separated from each other, and a position at which the gripping member releases the transfer medium, and L2 is a distance that links the position at which the gripping member releases the transfer medium, and the position at which the transfer medium transporting section starts to suction the transfer medium.

7. The image forming method according to claim 6, wherein suction power of the suction guide portion is a first suction power or a second suction power larger than the first suction power, and a transfer medium information is input to a control section, and the suction power of the suction guide portion is selectively controlled by the control section with the first suction power or the second suction power on the basis of the transfer medium information.

* * * * *